United States Patent [19]

Frantz et al.

[11] 4,431,249

[45] Feb. 14, 1984

[54] MALE/FEMALE CABLE CONNECTOR

[75] Inventors: Robert H. Frantz, Carlisle; Gary W. Hawk, Halifax, both of Pa.

[73] Assignee: AMP Incorporated, Harrisburg, Pa.

[21] Appl. No.: 364,123

[22] Filed: Mar. 31, 1982

[51] Int. Cl.[3] ..... H01R 13/506; H01R 13/58

[52] U.S. Cl. ..... 339/107

[58] Field of Search ..... 339/156 R, 99 R, 204, 339/207 R, 208, 209, 211, 214 R, 210 R, 210 M, 107, 97 R

[56] References Cited

U.S. PATENT DOCUMENTS

| | | | |
|---|---|---|---|
| 3,705,378 | 12/1972 | Elkins | 339/208 X |
| 3,745,515 | 7/1973 | Michaels | 339/156 R |
| 4,006,519 | 2/1977 | Long et al. | 29/749 |
| 4,032,211 | 6/1977 | Tucci | 339/99 R |
| 4,099,822 | 7/1978 | Carlisle et al. | 339/98 |
| 4,359,257 | 11/1982 | Lopinski et al. | 339/99 R |

*Primary Examiner*—Eugene F. Desmond
*Attorney, Agent, or Firm*—Russell J. Egan

[57] ABSTRACT

A male/female or half tap connector is formed by a central lacing block and a pair of mating housing members. The lacing block has a plurality of conductor passages extending therethrough in a first direction and pairs of terminal passages extending therethrough in a second direction, each pair of terminal passages intersecting a respective conductor passage. The mating housing members together define a lacing block receiving cavity and oppositely directed mating profiles. Each housing member carries a plurality of terminals, each with an insulation piercing, conductor engaging portion directed toward the cavity and aligned to enter a respective terminal passage to engage a conductor and latch with the lacing block.

14 Claims, 5 Drawing Figures

MALE/FEMALE CABLE CONNECTOR

The present invention is intended for use in making a tap, also known as a half tap, at the end of a cable.

There is frequently the requirement to terminate a cable with both female and male connectors at one location. This is often used to form a tapping arrangement and finds particular use for attaching peripherials to calculators and the like. Another application is in the telephone industry where it is desired to have two telephones at a single location. An example from the telephone industry can be found in U.S. Pat. No. 4,032,211 which shows two standard connectors of the type manufactured by the present assignee under the trademark CHAMP, in a back-to-back arrangement with individual wires laced into the terminals of both connectors.

The present invention satisfies the need for a male-female connector by providing a three-part connector having a central lacing block, which receives the cable and dresses the conductors thereof, and a pair of mating housing members which engage opposite sides of the central lacing block. Each of the mating housing members carries a plurality of terminals, with each terminal having an insulation piercing conductor engaging portion directed towards the central lacing block, and an oppositely directed mating configuration.

The present invention will be described by way of non-limiting example with reference to the accompanying drawings in which.

Figure 1:
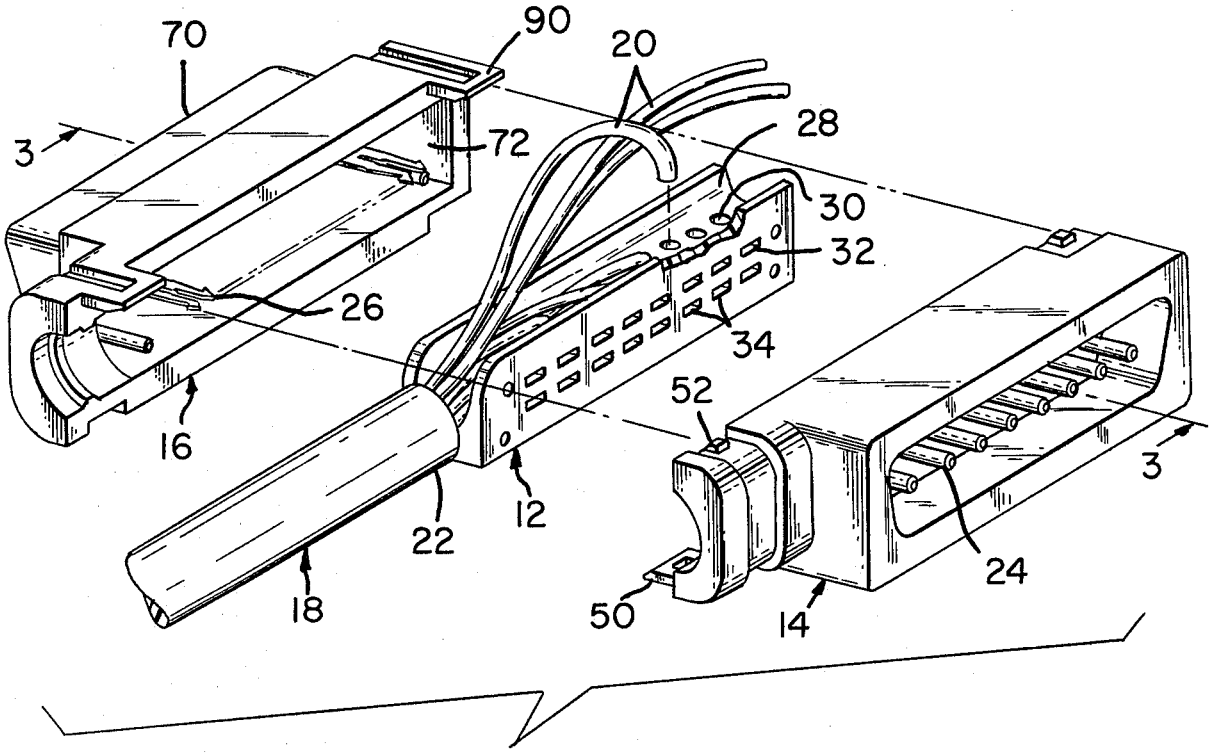
FIG. 1 is an exploded perspective view of the present invention.
Figure 2:
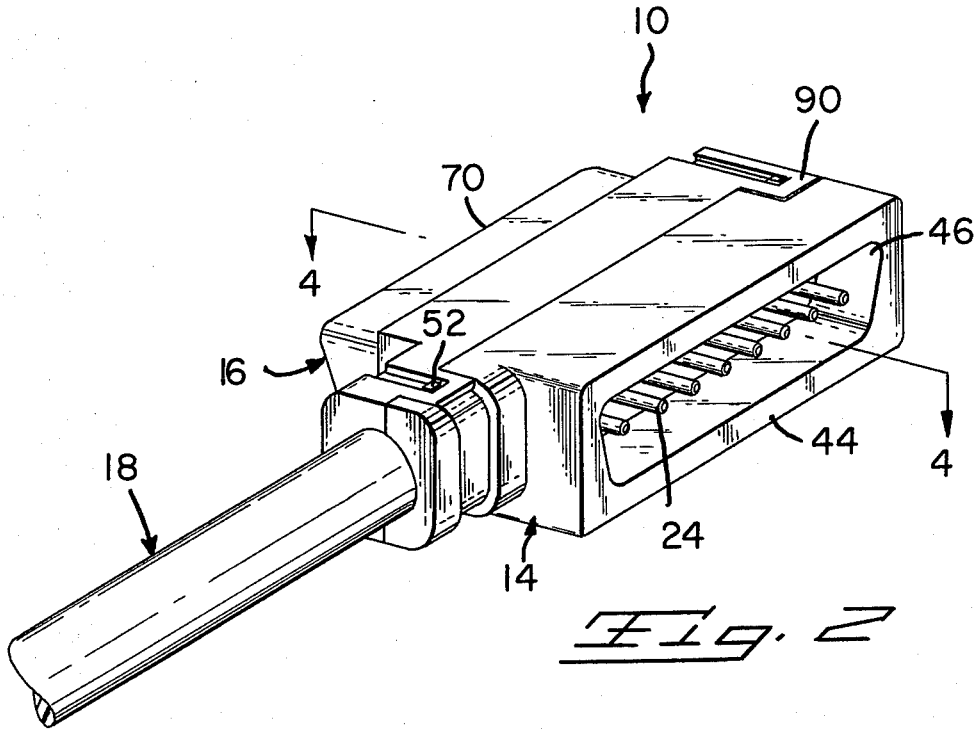
FIG. 2 is a perspective view of the subject invention in a fully assembled condition.

The subject connector 10 has a central lacing block 12, a plug housing 14, and a receptacle housing 16 for terminating a cable 18 which includes a plurality of conductors 20 in a jacket 22. The plug housing 14 includes a plurality of first terminals 24 and the receptacle housing 16 includes a plurality of second terminals 26.

The lacing block 12 is an elongated member of insulative material having a cable channel 28 extending the length of one side thereof. A plurality of conductor passages 30 extend through the block 12 in a first direction normal to the axis of the channel and are located in a spaced array. A plurality of first and second terminal passages 32, 34 extend in a second direction transversely through the lacing block 12. The terminal passages 32, 34 are in pairs normal to and intersecting respective ones of the conductor passages 30. Each terminal passage 32, 34 includes lugs 36, 38 forming latching shoulders 40, 42.

The plug housing 14 is preferably formed of insulative material and has a mating face 44 defining a plug receiving cavity 46 and an oppositely directed cavity 48 which receives part of the lacing block 12 therein. The plug housing 14 also includes latching arms 50 and latching lugs 52 for engaging with like arms and lugs of the receptacle housing 16. Each first terminal 24 is mounted in a respective passage 54 in the plug housing 14 and includes a pin 56 directed towards the plug cavity 46 and a slotted plate portion 58 directed towards the cavity 48 which receives the lacing block 12. The slotted plate portion 58 defines a central conductor receiving slot 60 and a pair of arms 62, 64 with outwardly directed shoulders 66, 68, respectively.

The receptacle housing 16 is also preferably formed of insulative material and has a mating face 70 which receives a mating receptacle (not shown) thereon. The receptacle housing 16 also has an oppositely directed cavity 72 which receives a portion of the lacing block 12 therein. The second terminals 26 are mounted in respective passages 74 with mating portions 76 directed towards the mating face 70 and slotted plate portions 78 directed towards, and extending into, the cavity 72. The slotted plate portion 78 defines a conductor receiving slot 80 and a pair of arms 82, 84 each with outwardly directed shoulders 86, 88. The housing is also provided with a plurality of latching arms 90 and lugs (not shown).

Figure 3:
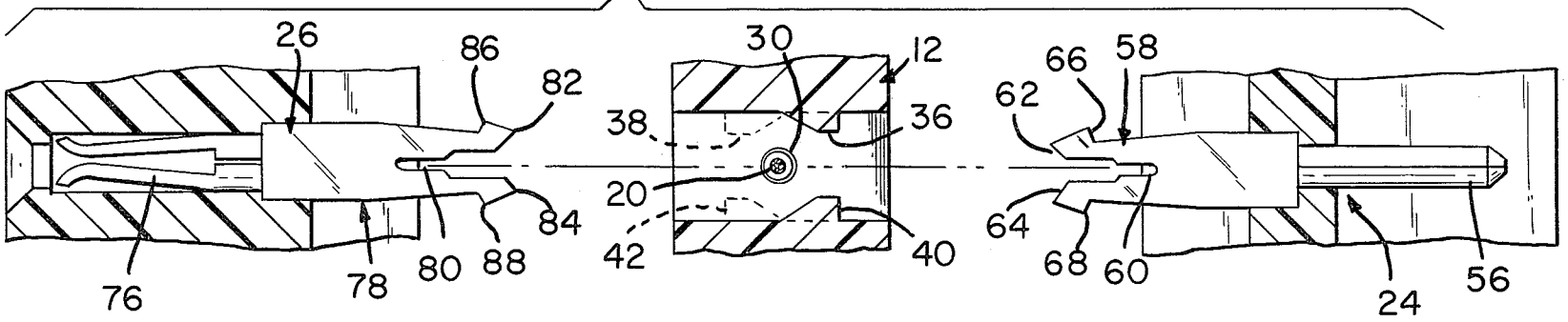
FIG. 3 is an exploded fragmentary section taken along line 3—3 of FIG. 1.
Figure 4:
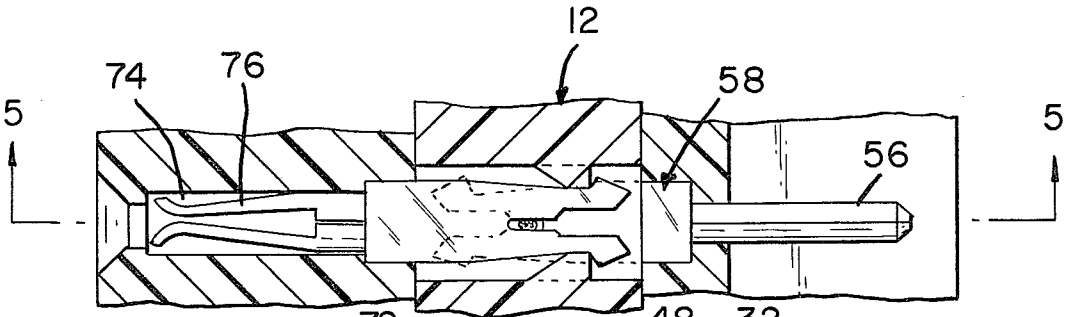
FIG. 4 is a fragmentary section taken along line 4—4 in FIG. 2 showing the invention in the assembled condition.
Figure 5:
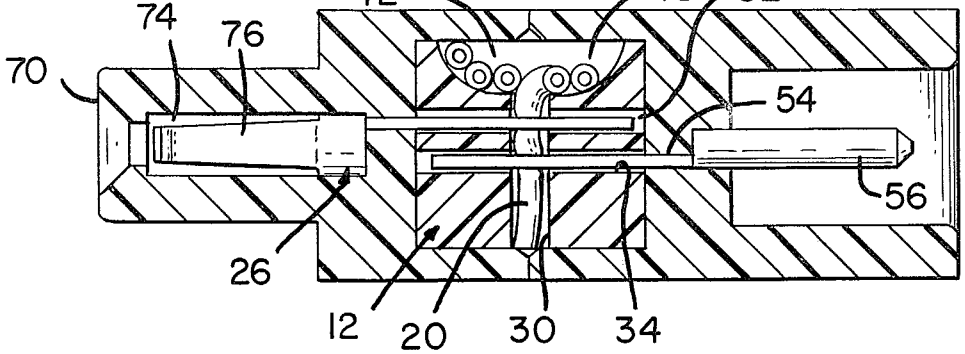
FIG. 5 is a section taken along line 5—5 of FIG. 4.

The present invention is assembled by first removing the outer jacket 22 of the cable 18 to expose the individual conductors 20. The conductors 20 are then laced through the respective passages 30 of the lacing block 12 and trimmed. Each mating plug housing 14 and receptacle housing 16 is then applied from opposite sides of the lacing block 12 to effect an insulation piercing termination of the respective conductors 20, as shown in FIGS. 3 to 5. Each conductor 20 will be terminated by a first terminal 24 and a second terminal 26. The connector 10 will be held securely together by both the interaction of the respective latching arms 50 and 90 with the lugs 52, and also by the engagement of the shoulders 66, 68, 86, 88 of the respective first and second terminals 24, 26 with shoulders 42, 40 respectively in the terminal passages 34, 32 of the lacing block 12.

It should be noted that it would be within the scope of the present invention to employ any combination of plug and receptacle housings as well as pin and socket terminals. The invention is also not limited to single rows of terminals. The lacking block 12 and cavities 48, 72 can be profiled for polarized mating.

We claim:

1. A connector assembly for terminating a cable providing two oppositely directed interfaces, said connector comprising:

a lacing block adapted to receive and position conductors of a cable;

first and second mating housing members each having oppositely directed mating faces and defining therebetween a lacing block receiving cavity;

each said housing carrying a plurality of terminals in a like spaced array, one terminal of each said housing electrically and mechanically engaging a respective conductor in said lacing block.

2. The connector according to claim 1 wherein said lacing block is an elongated member of insulative material having a cable receiving channel extending along the length of one side thereof, a plurality of conductor passages extending through the block in a first direction transversely of said cable channel and a plurality of pairs of terminal passages extending transversely therethrough in a second direction, each pair of terminal passages intersecting a respective conductor passage.

3. A connector according to claim 1 wherein at least one said housing member is profiled to receive a mating plug member.

4. A connector according to claim 1 wherein at least one said housing member is profiled to receive a mating receptacle member.

5. A connector according to claim 1 wherein one said housing member is profiled to receive a mating plug member and the other housing member is profiled to receive a mating receptacle member.

6. A connector according to claim 1 further comprising cable strain relief means integral with said housing members.

7. A connector according to claim 1 further comprising latching means for securing said housing members together.

8. A connector according to claim 1 wherein each said terminal is provided with a slotted plate portion for engaging said respective conductor and latchingly engaging in said lacing block.

9. A connector according to claim 1 further comprising polarizing means on said lacing block and said housings.

10. A connector according to claim 1 wherein each said terminal passage in said lacing block includes lug means forming shoulders, and each said terminal has lug means for latching engaging respective ones of said shoulders of said lacing block.

11. An electrical connector for effecting a tap between a pair of mating male and female connector members, the subject connector having a pair of mating housing members defining a cavity therebetween and having outwardly directed faces profiled to receive a respective male and female member of the mated connector pair, each connector housing having therein a plurality of terminals in a spaced array each terminal having a mating portion directed towards the mating face and a slotted plate portion directed towards said cavity, characterized by:

a lacing block received in said cavity, said lacing block having an elongated rectangular profile with a cable channel extending the length of one side thereof, a plurality of conductor passages extending through said lacing block in a first direction normal to said cable channel in a spaced array, and a plurality of pairs of terminal passages extending in a second direction between sides of said lacing block adjacent the side having said cable channels with each pair of terminal passages intersecting a respective conductor passage whereby conductors of a cable laid in the channel and threaded through respective conductor passages are terminated by application of the housings about the lacing block with the respective terminals entering respective terminal passages to terminate respective conductors.

12. An electrical connector according to claim 11 wherein each said terminal passage is profiled and each said terminal has a mating profile to effect a latching engagement.

13. An electrical connector according to claim 11 wherein said lacing block and said mating housing members are polarized.

14. An electrical connector according to claim 11 wherein said mating housing members further include cable strain relief means.

* * * * *